US007210435B2

(12) United States Patent
Decuir, Jr.

(10) Patent No.: US 7,210,435 B2
(45) Date of Patent: May 1, 2007

(54) DESMODROMIC VALVE SYSTEM AND RETROFIT KIT FOR CONVENTIONAL PUSHROD ENGINES INCLUDING REPLACEABLE CAM LOBES FOR ADJUSTING LIFT AND DURATION AND HYDRAULIC LIFTERS FOR INCREASED RELIABILITY

(76) Inventor: Julian A. Decuir, Jr., P.O. Box 720801, Pinon Hills, CA (US) 92372

( * ) Notice: Subject to any disclaimer, the term of this patent is extended or adjusted under 35 U.S.C. 154(b) by 105 days.

(21) Appl. No.: 11/177,205

(22) Filed: Jul. 8, 2005

(65) Prior Publication Data

US 2007/0006835 A1 Jan. 11, 2007

(51) Int. Cl.
*F01L 1/30* (2006.01)

(52) U.S. Cl. ..... 123/90.24; 123/90.25; 123/90.26; 123/90.44

(58) Field of Classification Search ..... 123/90.24, 123/90.25, 90.26, 90.44, 90.6
See application file for complete search history.

(56) References Cited

U.S. PATENT DOCUMENTS 5,347,965 A 9/1994 Decir
5,394,843 A 3/1995 Decir
5,732,670 A * 3/1998 Mote, Sr. ..... 123/90.24

* cited by examiner

*Primary Examiner*—Thomas Denion
*Assistant Examiner*—Zelalem Eshete
(74) *Attorney, Agent, or Firm*—Stetina Brunda Garred & Brucker

(57) ABSTRACT

A desmodromic valve and cam system is provided which is adapted to be installed into an internal combustion pushrod engine. The system includes a camshaft assembly having a plurality of removably attached cam lobes installed onto a main camshaft; a valve connector assembly installed onto a distal tip of each valve; a rocker having a valve movement end mechanically linked to a respective valve connector and a pushrod connecting end mechanically linked to an upper distal end of a pushrod; a hydraulic lifter follower assembly assigned to each valve which includes a pin disposed on a distal end thereof which is adapted to engage and track a follower groove formed on each respective cam lobe; and a pushrod assigned for each valve, each pushrod having lower distal end mechanically linked to a respective hydraulic follower lifter. The configuration of the aforementioned system eliminates the need to use valve springs to return the valves to a closed position, thereby, increasing horsepower and fuel efficiency, while simultaneously reducing emissions.

21 Claims, 6 Drawing Sheets

DESMODROMIC VALVE SYSTEM AND RETROFIT KIT FOR CONVENTIONAL PUSHROD ENGINES INCLUDING REPLACEABLE CAM LOBES FOR ADJUSTING LIFT AND DURATION AND HYDRAULIC LIFTERS FOR INCREASED RELIABILITY

CROSS-REFERENCE TO RELATED APPLICATIONS

The present application is related to U.S. patent application Ser. No. 10/838,107, entitled "Desmodromic Valve and Adjustable Cam System," filed on May 3, 2004 by inventor Julian A. Decuir, the content of which is expressly incorporated by reference herein in its entirety.

The present application is also related to U.S. patent application Ser. No. 11/138,611, entitled "Desmodromic Valve Retrofit System with Replaceable Cam Lobes for Adjusting Duration & Hydraulic Lifters for Reliability," filed on May 25, 2005 by inventor Julian A. Decuir, the content of which is expressly incorporated by reference herein in its entirety.

STATEMENT RE: FEDERALLY SPONSORED RESEARCH/DEVELOPMENT

Not Applicable

BACKGROUND OF THE INVENTION

1. Field of the Invention

The present invention relates to desmodromic valve and cam systems for traditionally configured internal combustion engines which utilize pushrods. In particular, the present invention relates to a valve train and cam system which eliminates the springs found in conventional valve trains by implementing a design which utilizes cam lobes having an internal follower groove in combination with hydraulic lifter follower assemblies. The present invention also relates to camshafts which have replaceable cam lobes providing various duration/lift adjustability options.

2. Background of the Invention

Most conventional internal combustion piston driven engines utilize valve trains to induct an air/fuel mixture into the cylinders and to expel the burned air/fuel mixture from the cylinders. Typically, each cylinder is assigned at least one intake poppet valve and at least one exhaust poppet valve. The valves are typically pushed down by rockers thereby opening the valve. To close the valve, that is to pull the valve back up so that it seats, most conventional valve trains utilize a spring which concentrically surrounds the valve stem. When the valve stem is pushed down by the rocker to open the valve, the spring is compressed. When the rocker lifts off from the distal tip of the valve stem, the valve then closes when the spring decompresses, thereby, pulling the valve stem up through the valve guides until the head of the valve seats in the valve seat.

The aforementioned conventionally configured valve train systems for opening and closing the valves has proven to be highly effective and reliable in the past. However, closing the valve by the force of the spring does have some disadvantages. Most notably, pushing the valves open against the force of the springs consumes engine power. The springs in an engine's valve train induce considerable tension into the valve train because they continuously force the valve mechanism against the rocker as the camshaft rotates.

In other words, the valve springs are continuously pushing the valves closed. Another disadvantage is that because the cam mechanism cannot afford to have any "bounce" from the springs, the cam profile has to be somewhat gentle, i.e., it must gently push the valve. Another disadvantage is that when the motor is turned at high RPM's, the valves can "float" and hit the piston. Valve float happens when the speed of the engine is too great for the valve springs to handle. As a result, the valves will often stay open and/or "bounce" on their seats.

To overcome these disadvantages, innovative desmodromic valve trains have evolved over about the last century; however, in a very slow technological pace and in most applications with little or limited success. The term "desmodromic" arises from the two Greek words: "desmos" (controlled or linked), and "dromos" (course or track). A desmodromic system is also known as system that provides "positive valve actuation" wherein both strokes are "controlled". In other words, desmodromic valves are those which are positively closed by a leverage system or follower, rather than relying on the more conventional springs to close the valves. Typically, a desmodromic valve operating system utilizes a camshaft that controls both the opening and closing of the valve.

Desmodromic valve trains have several advantages over conventional spring closed valves trains. A first major advantage is that in a desmodromic valve system there is almost no wasted energy in driving the valve train. In other words, the constant force that the springs exert on the valve train is removed. Another advantage is that because there is no tension and no possibility of "bounce" in the desmodromic system, the cam profiles can be as steep as the engine designer wishes them to be. This desirable aspect allows the engine to be more powerful. Thus, the manufacturer can use radical cam grinds or profiles for increasing performance. Another advantage is that when the motor is turned at high RPM's or even over-revved, the valves are still controlled, whereas when the valves are returned by springs the valves sometimes can "float" and hit the piston.

Nevertheless, even though desmodromic valve trains have the aforementioned advantages, they have had limited success in large scale commercial applications due to reliability issues, complexity of design, and valve train binding to name a few reasons. For instance, one of the major disadvantages of desmodromic valve trains is their sensitivity to change in size of the separate components of the system. In particular, the individual components (valves, cam lobes, rockers, etc.) of the valve train become enlarged at elevated temperatures because of thermal expansion of the metallic components. Also, the components of the valve train wear, thereby, decreasing the size of the components. As a cumulative result, of both cyclic expansion and contraction of the components caused by heating, and the shortening of components caused by wear, the tolerances of the valve train can change. The end results are components such as valves which do not seat properly, or unwanted binding in the valve train. Therefore, one of the major difficulties of prior art desmodromic valve train systems is the critical and accurate adjustment of various working components to ensure that the components operate together as intended without being subjected to binding, tension or excessive friction which results from the change of size in the individual components.

Another one of the problems with the aforementioned desmodromic valve train systems is that they have not been adapted to be installed or "retrofit" into existing modern conventional pushrod engines. That is to say, the aforementioned prior art desmodromic systems appear to utilize specialized designs which requires unique heads, valve trains and/or engine blocks. Thus, to use the aforementioned desmodromic systems, entirely new engine platforms have to be designed and built. Unfortunately, however, most manufacturers are not willing to invest the sizeable amounts of capital to build such desmodromic engines, or much less, market vehicles with engine platforms which have not been proven or which have had a past history for reliability problems.

Therefore, it would be advantageous to provide a reliable desmodromic valve and cam system that may be either integrated into a new engine design or of which may be retrofit onto an existing engine design without requiring the head or valves to be replaced. Furthermore, it would desirable to provide the aforementioned desmodromic system for a conventional pushrod engine, considering the popularity and success of the pushrod type platform. By providing a retrofit desmodromic system for pushrod engines, the cost of the upgrade could be maintained lower than that of a system which requires the entire head and valve train to be replaced. It would further be advantageous to provide a desmodromic valve and cam system which is simple and inexpensive to manufacture. Furthermore, it would be desirable to provide a desmodromic valve and cam system which would have interchangeable cam lobes such that the cam duration/lift could be adjusted. With such a feature, various cam lobes having varying profiles, durations, lift, etc. could be utilized on the same system by merely replacing the cam lobes. Such features would provide a wide array of adjustability in regards to being able to tune the engine's performance characteristics.

BRIEF SUMMARY OF THE INVENTION

The present invention provides a desmodromic valve and cam system which utilizes hydraulic lifters and replaceable cam lobes that may be integrated into a new engine design or of which may be retrofit into an existing conventional pushrod engine without requiring the engine block, head or valves to be replaced or reworked. The present invention operates more efficiently than conventional valvetrains since binding tension is reduced from the valvetrain resulting in greater horsepower, better fuel economy and reduced emissions; while the incorporation of hydraulic lifters or the like makes the present invention desmodromic system more reliable. By providing a retrofit desmodromic system, the cost of installing the present invention into a vehicle is significantly reduced. Furthermore, the present invention is simple to manufacture and may be retrofit onto conventional pushrod type engines which are one of the most popular and successful automotive engines ever produced. Furthermore, the present invention's interchangeable cam lobe kits may be utilized on the same system, thereby, providing a wide array of adjustability in regards to being able to tune the engine's performance characteristics.

According to a first embodiment of the present invention, a desmodromic valve and cam system is provided which is adapted to be installed into an internal combustion pushrod engine comprising an engine block and at least one head which utilizes at least one intake and exhaust valve per cylinder. The system may include, but is not limited to a main camshaft assembly adapted to be received within a plurality of journals disposed internally within the engine block. The camshaft assembly includes a cam lobe assigned to each valve, where each cam lobe is adapted to be removably installed onto a main camshaft. Each cam lobe is defined by a pair of opposing sides, perimeter edge, mounting hole disposed through the opposing sides in a normal orientation, and follower groove formed in at least one side of the cam lobe which is representative of a desired lift and duration performance characteristic. Also, a valve connector assembly may be installed onto a distal tip of each valve. Furthermore, a rocker is provided which is defined by a valve movement end and a pushrod connecting end, wherein the valve movement end is adapted to be mechanically linked to a respective valve connector assembly such that the rocker can either push down or pull up a respective valve. The pushrod connecting end is adapted to be mechanically linked to an upper distal end of a pushrod such that the rocker can either push down or pull up a respective pushrod. Moreover, the system may include hydraulic lifter follower assembly assigned to each valve which is adapted to be received within a lifter seat disposed within the engine block, wherein each lifter assembly may have a pin or any other means disposed on a distal end thereof which is adapted to engage and track a respective follower groove on a respective cam lobe. Additionally, the system may include pushrods assigned to each valve, wherein each pushrod has an upper and lower distal end, the upper distal end being mechanically linked to the pushrod connecting end of a respective rocker and the lower distal end being mechanically linked to a respective hydraulic follower lifter.

As a result of the aforementioned desmodromic system configuration, when the main camshaft assembly rotates, the cam lobes impart reciprocal motion to the hydraulic lifters, which impart reciprocal motion to the pushrods, which impart a rocking motion to the valve movement end of the rocker, which results in each valve being reciprocally moved upwards to a closed position or downwards to an open position as a function of each cam lobe's lift and duration. Moreover, this is all accomplished without the need to use valve springs to return the valves to a closed position. And, according to another aspect of the present invention, the hydraulic lifter follower assemblies automatically adjust valve lash for each respective valve.

According to another aspect of the present, the valve connector assembly comprises a valve connecting fitting comprising a rocker connecting end portion with a receiving slot formed therein which is adapted to slidably and rotatably receive a connecting pin from the valve movement end of the rocker; and a lower fitting portion adapted to receive a valve keeper fitting, the lower fitting portion including a hollow valve tip seat adapted to receive the distal end of the a respective valve; a valve keeper fitting adapted be fastened to the lower fitting portion; and a pair of valve keepers.

In another aspect of the present invention, the valve keeper fitting has a bore disposed there through for receiving a valve stem from each respective valve, while the keeper fitting further includes an upper portion having a frustro-conical shaped seat formed therein; and a lower portion having a flange adapted to be received by a tool; wherein each respective valve has at least one radial groove formed on the valve stem for receiving the pair valve keepers; and wherein the valve keeper fitting is adapted to be installed into the lower fitting portion of the valve connecting fitting such that the pair of valve keepers are received into the frusto-conical shaped seat and maintained by a compression fit.

Moreover, another aspect of the present invention, the valve connector assembly comprises a main valve connector body adapted to be connected to the distal tip of a respective valve, the body defined by a center axis, a lower end having a radial flange with a hole disposed there through for receiving the upper end of the valve, an upper end having a pair of opposing yokes arms projecting upwards, each arm having a pin receiving hole, and an internal cavity disposed through the body about the center axis from the upper end and terminating within the body to form a backside of the radial flange about the center axis; a first connecting pin installed into the pin receiving holes of the yoke arm; a linking member having a pair pin receiving holes, the linking member being rotatably connected to the second connecting pin via one of the pin receiving holes and further rotatably connected to the valve connector pin disposed on the valve movement end of the rocker via the other pin receiving hole. According to yet another aspect of the present invention, a coil spring may be positioned if desired between the distal tip of the valve stem and the valve connector for dampening shock imparted to the valve.

According to another aspect of the present invention, the valve connector assembly comprises a main valve connector body adapted to be connected to the distal tip of a respective valve, the body defined by a center axis, a lower end having a radial flange with a hole disposed there through for receiving the upper end of the valve, an upper end having a pair of opposing yokes arms projecting upwards, each arm having a pin receiving hole, and an internal cavity disposed through the body about the center axis from the upper end and terminating within the body to form a backside of the radial flange about the center axis; a first connecting pin installed into the pin receiving holes of the yoke arm; a linking member having a pair pin receiving holes, the linking member being rotatably connected to the second connecting pin via one of the pin receiving holes and further rotatably connected to the valve connector pin disposed on the valve movement end of the rocker via the other pin receiving hole.

According to other aspects of the present invention, the valve connector further comprises at least one first wave washer adapted to be received by the valve stem, the first wave washer being positioned adjacent the backside of the radial flange; a pair of frustro-conically shaped valve keepers adapted to be received by at least one radial groove formed on the valve stem for receiving the pair of valve keepers, the valve keepers being positioned over the at least one first wave washer; at least one second wave washer adapted to be received by the valve stem, the second wave washer being positioned over the valve keepers; and at least one locking retainer adapted to be received by the valve stem, the at least one locking retainer positioned over the at least one second wave washer.

According to another aspect of the present invention, each rocker may comprise a main body having a bored disposed there through for receiving a pair of rocker bearings and a rocker shaft which is adapted to be mounted to a mounting stud protruding from the head; a valve movement end comprising a pair of opposing arms having a receiving slot formed there between and a valve connecting pin transversely spanning across both arms, the been being adapted to be rotatably received by a respective valve connector assembly; and a pushrod connecting end which has a threaded hole which is adapted to receive a ball joint assembly.

According to another aspect of the present invention, the hydraulic lifter follower assembly may comprise a generally cylindrically-shaped lifter body having a cylindrical cavity disposed therein with an opening to the cavity formed on one end thereof, the lifter body having a notched portion disposed on the other end thereof, the notched portion including a groove pin or any other equivalent means to be received by a respective follower groove from a cam lobe; a coil spring concentrically adapted to be retained internally within a cylindrical cavity; a cylindrical shaped lower ball seat adapted to be retained internally within the cylindrical cavity above the coil spring; an upper ball receiving seat sleeve adapted to be received by a respective pushrod; and a lifter cap adapted to be received by the respective pushrod, the lifter cap further adapted to be attached to the opening to the cavity formed on the end of the lifter body; wherein oil is fed through each respective pushrod into the cavity formed in the lifter body; and wherein the lifter acts as a dampener that maintains a constant, yet adjustable tension, to the rocker.

According to another aspect of the present invention, the camshaft assembly further may include a drive hub removably attached to one end of the camshaft assembly adapted to receive a timing drive sprocket; a timing gear hub removably attached to the camshaft assembly proximate the drive hub; a plurality of camshaft bushings removably attached to the camshaft assembly; and an end hub removably attached to the other end of the camshaft assembly.

According to yet still another aspect of the present invention, the mounting hole of each cam lobe has a cam lobe key receiving slot formed along a length of the mounting hole; and the main camshaft has a camshaft key receiving slot disposed in an exterior surface of the shaft for each respective cam lobe; wherein a key is installed into the cam lobe key receiving slot for each cam lobe and a respective camshaft key receiving slot is assigned to each respective cam lobe for rigidly securing the cams lobes to the main camshaft.

According to another aspect of the present invention, the desmodromic valve and adjustable cam system may further comprise a plurality of cam lobe assembly kits adapted to be installed and removed onto the main camshaft, wherein each kit provides a differing cam profile offering a unique set of lift and duration tuning characteristics for each respective kit.

According to another embodiment of the present invention, a desmodromic valve and cam system retrofit kit for a pushrod engine is provided. The kit may include, but is not limited to, a main camshaft assembly having removable cam lobes, each cam lobe having mounting hole formed there through, and follower groove formed in at least one side of the cam lobe; a valve connector assembly adapted to be installed onto a distal tip of each valve of the engine; a rocker having a valve movement end and pushrod connecting end, the valve movement end being adapted to be mechanically linked to a respective valve connector assembly such that the rocker can either push down or pull up a respective valve and the pushrod connecting end being adapted to be mechanically linked to an upper distal end of a pushrod such that the rocker can either push down or pull up a respective pushrod; a hydraulic lifter follower assembly assigned to each valve which is adapted to be received within a lifter seat disposed within the engine block, each lifter assembly having a connecting means disposed on a distal end thereof which is adapted to engage and track a respective follower groove on a respective cam lobe; and a pushrod assigned to each valve, each pushrod having an upper and lower distal end, the upper distal end adapted to mechanically linked to the pushrod connecting end and the lower distal end adapted to be mechanically linked to a respective hydraulic follower lifter. As a result of the configuration of the aforementioned kit, the conventional valve springs may be moved from the engine's valvetrain, thereby increasing horsepower, fuel efficiency while reducing emissions.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention provides a desmodromic valve and adjustable cam system for a conventional pushrod combustion engine which eliminates the use of valve springs normally used to close poppet valves. The system may be retrofit onto an existing engine design or which the features thereof may be integrally included into an entirely new engine design. For instance, the present invention may be retrofit to existing engine designs, such as those used in conventional pushrod V8's, V6's, in-line 4's, in-line 6's or the like. Moreover, the present invention may be utilized with gasoline type engines or diesel engines. The present invention may also utilize a stock engine block, a stock head and stock valves without any modifications. Also, the scope of the invention should not be limited to the exemplary embodiments disclosed in the instant specification. Rather, the exemplary embodiments of the present invention desmodromic cam and valve system should be viewed as merely a few embodiments of numerous engine systems and platforms which may utilize the fundamental concepts taught and disclosed in the instant application.

Figure 1:
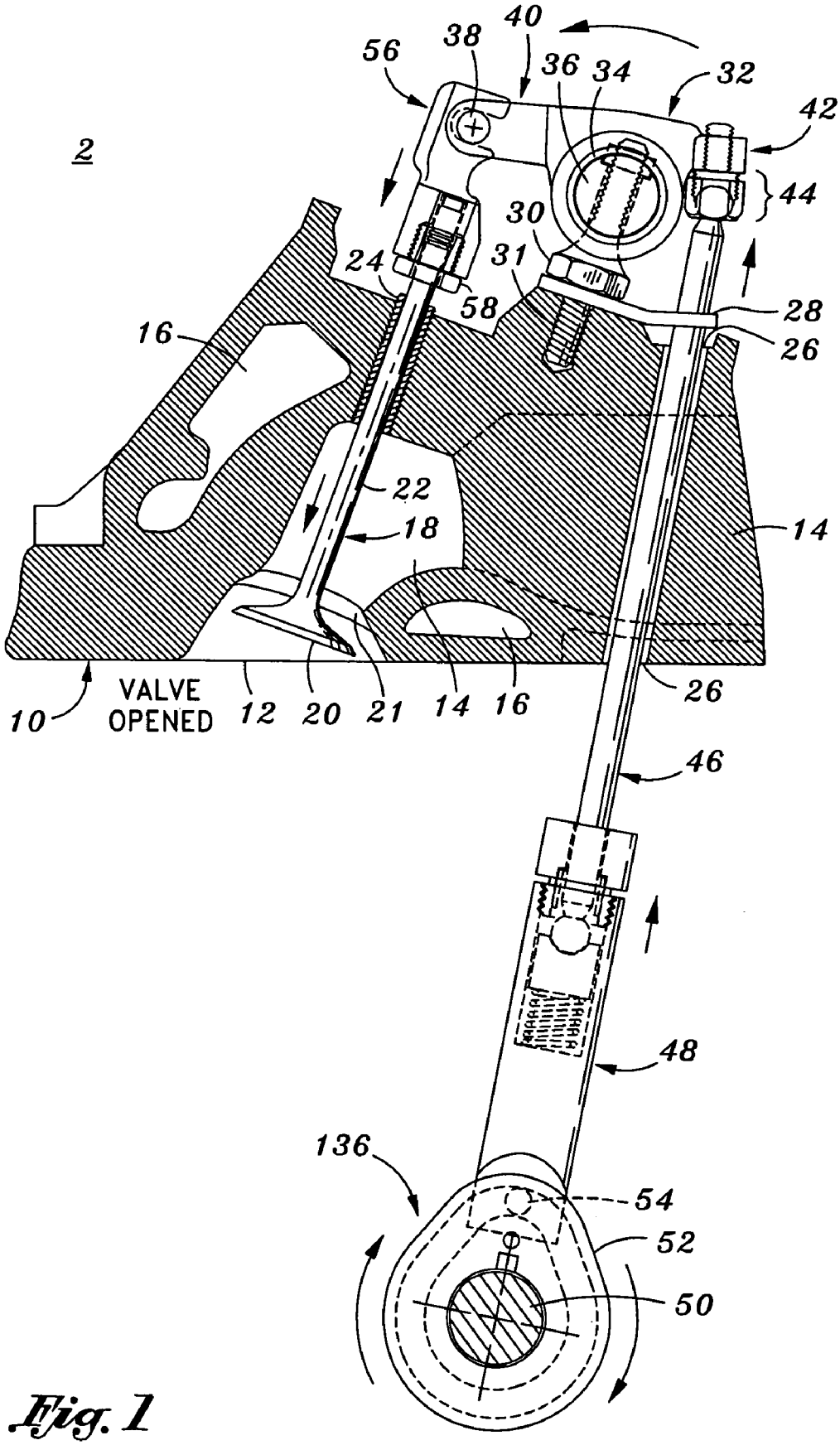
FIG. 1 shows a sideview and partial cross-section of the present invention desmodromic valve and cam system which may include a stock head, stock valve, valve connector assembly, rocker, pushrods, hydraulic lifter follower assembly, and cam lobe with following groove wherein the valve is positioned open, according to an aspect of the present invention.
Figure 2:
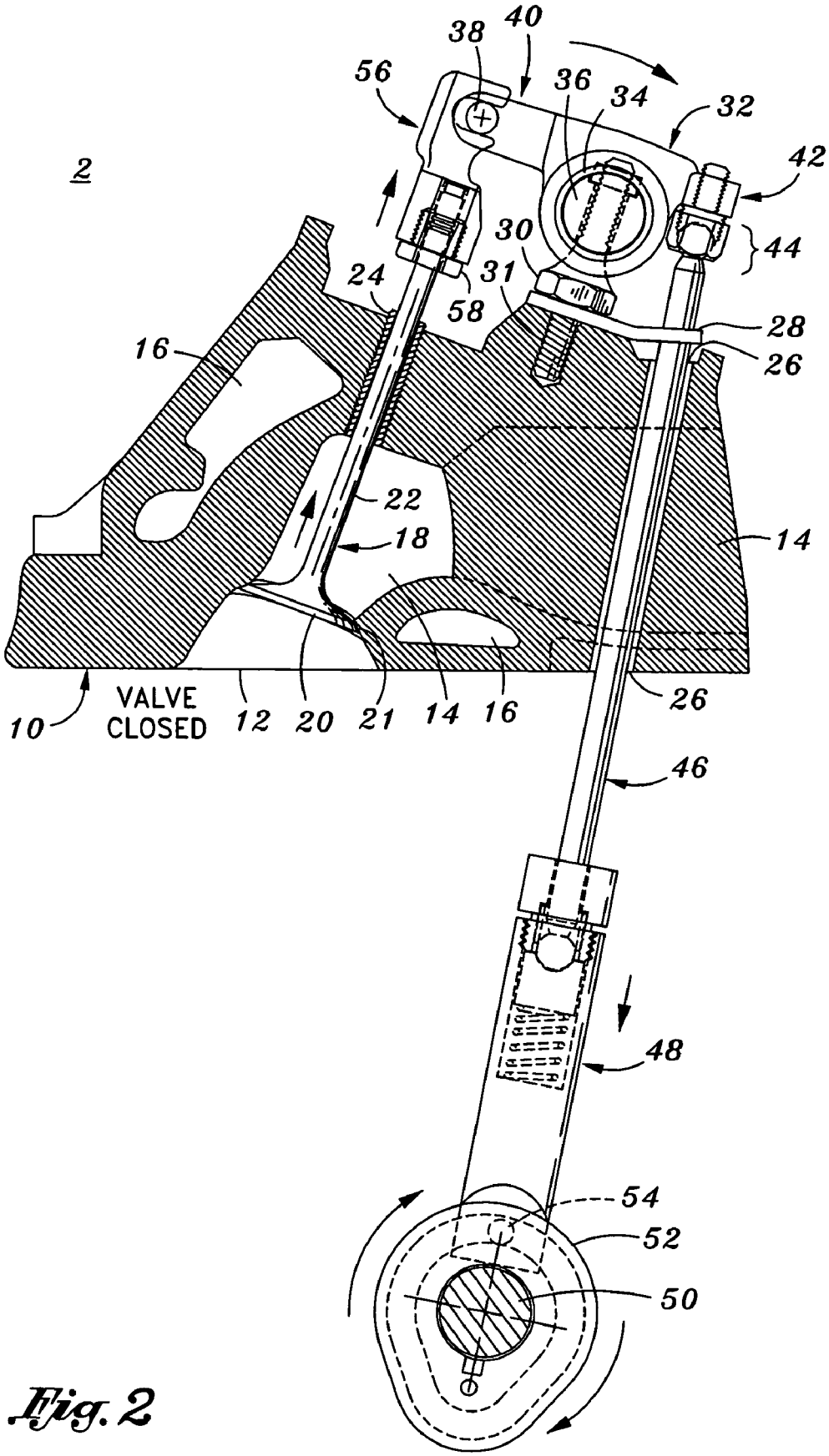
FIG. 2 shows the same sideview and partial cross-section from Figure, except the valve is positioned closed, according to an aspect of the present invention.

Referring now to FIGS. 1 and 2, which show a sideview and partial cross-section of an exemplary desmodromic valve and cam system 2 which may include a stock head 10, a plurality of stock poppet valves 18, a valve connector assembly 56, a connecting rocker 32, a pushrod 46, a hydraulic lifter follower assembly 48, and a cam lobe 52 with following groove 53, according to an aspect of the present invention. In particular, the illustrated embodiment of the desmodromic valve and cam system 2 has been adapted to be retrofitted/and or installed into a conventional pushrod engine which includes a single camshaft internally disposed within the engine block. Furthermore, the illustrated embodiment includes two valves per cylinder (intake/exhaust); however, it is noted that the present invention may also be adapted to engines which have more than two valves dedicated to each cylinder. The exemplary stock head 10 includes a combustion chamber portion 12, an intake plenum 14, and coolant passages 16. The head 10 further includes a passageway which includes a valve guide 24 that is adapted to slidably receive the poppet valve 18, thereby, allowing the valve 18 to be guided in an up and down reciprocal motion. When the poppet valve 18 is pushed downwards by the connecting rocker 32, the valve head 20 is removed from the seat 21, thereby, allowing the intake fuel/air mixture to be introduced into the engine's cylinders (see FIG. 1 for valve opened configuration). When the poppet valve 18 is pulled upwards by the connecting rocker 32, the valve head 20 is positioned so that it seats in the valve seat 21 (see FIG. 2 for valve opened configuration). The valve guides 24 may be the stock valve guides normally utilized on the conventional head 10. The exemplary head 10 also includes a standard pushrod passage 26 for each pushrod 46 (i.e., one pushrod for each valve as is found in conventional pushrod engines).

Still referring to FIG. 1, the desmodromic valve and cam system 2 is best understood by describing subcomponent assemblies that make up the present invention. One subassembly is the valve connecter assembly 56 and poppet valve 18. The poppet valve 18 is removably attached to the valve connector assembly 56 via a valve keeper fitting 58. The aforementioned subassembly is illustrated in further detail in FIG. 3, and described in greater detail later in the specification. Another subassembly is the connecting rocker 32 and affiliated attaching hardware, which includes a stock rocker mounting stud 30 (see FIGS. 1 and 2) and stock pushrod guide plate 28 (see FIGS. 1 and 2). The rocker mounting stud 30 is installed into a threaded bore 31 which is provided in conventional heads 10 for mounting the rockers, while the pushrod guide plate 28 is fastened to the top of the head 10 by the rocker mounting stud 30. The aforementioned subassembly is illustrated in greater detail in FIGS. 5 and 6, and described in greater detail later in the specification. The next subassembly includes the pushrod 46 and hydraulic lifter follower assembly 48 which is illustrated in greater detail in FIGS. 7 and 8, and described in greater detail later in the specification. Additionally, a camshaft assembly 136 is provided which includes a plurality removable cam lobes 52 with following grooves 53 disposed on one side thereof. The hydraulic lifter follower assembly 48 has a following groove pin 54 disposed on the distal end thereof, which is adapted to be retained within the cam lobe following groove 53. As shown in FIGS. 1 and 2, when the camshaft assembly 136 rotates, the cam lobe 52 forces the hydraulic lifter assembly 48 and pushrod 46 upwards or downwards in a reciprocal manner, thereby creating the connecting rocker 32 to "rock" up and down in a reciprocal manner such that the poppet valve 18 opens and closes as a function of the cam lobe 52 input. The camshaft assembly 136 is illustrated in greater detail in FIGS. 9 and 10, and described in greater detail later in the specification.

Figure 3:
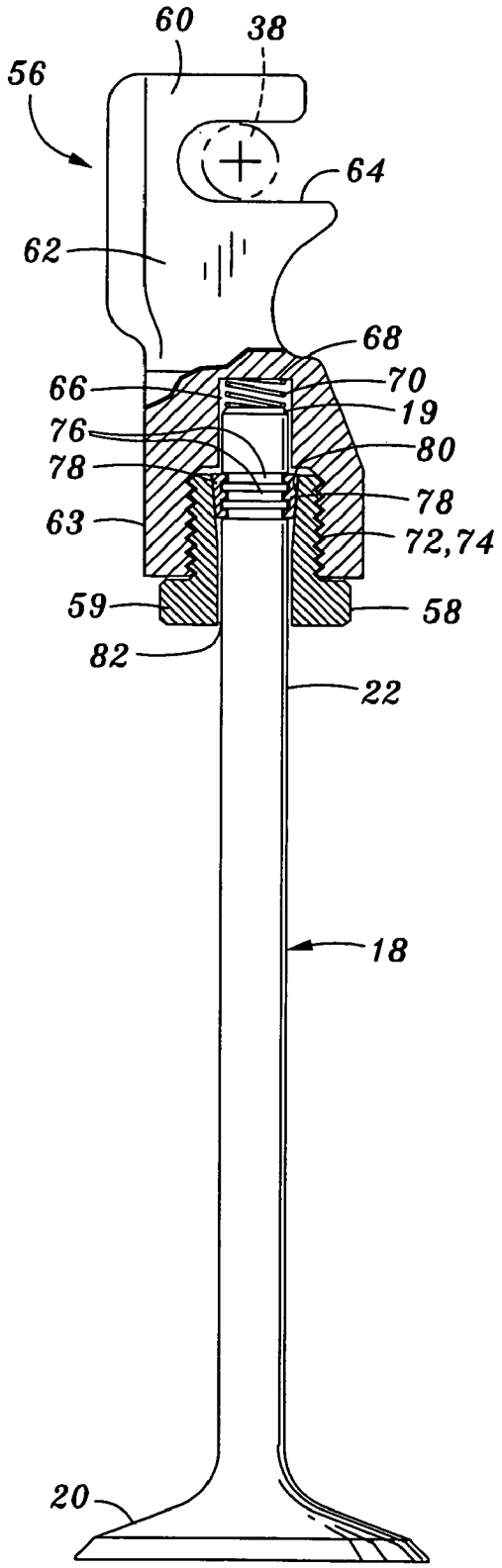
FIG. 3 shows a detailed cross-sectional view of the valve and valve connector assembly from FIGS. 1 and 2, which includes the valve, a pair of valve keepers, the valve keeper fitting, an internal valve stem dampening spring, and the valve connector, according to an aspect of the present invention.

FIG. 3 shows a detailed cross-sectional view of an exemplary stock valve 18 and valve connector assembly 56 which includes a valve keeper fitting 58, a valve connecting fitting 62, a pair of valve keepers 78, and an internal valve stem dampening spring 70, according to an aspect of the present invention. The valve connecting fitting 62 comprises two main portions, including a lower valve fitting portion 63 and a rocker connecting end 60. The valve connector assembly 56 is used to interconnect the rocker connecting end 60 to the valve movement end 40 of the connecting rocker 32, and in particular, rotatably and slidably to valve connector pin 38. Preferably, the lower valve fitting 63 has a hexagonal cross-section, similar to that of conventional fluid fittings, such that the lower valve fitting 63 may be engaged by a tool, such as a box wrench. The lower valve fitting 63 internally defines a cap having female threads 74 or the like internally formed therein which are adapted to receive an upper portion of the valve keeper fitting 58. Furthermore, internally formed within the valve connecting fitting 62 is a valve tip seat 66 which is adapted to receive the distal tip 19 of the valve stem 22. And, as already discussed, integrally formed to the upper portion of the valve connection fitting 62 is the rocker connector end 60 which includes a receiving slot 64 formed therein which is adapted to slidably and rotatably receive the valve connecting pin 38 from the connected rocker 32.

Still referring to FIG. 3, it will now be explained how the exemplary poppet valve 18 is connected to the valve connecting assembly 56. The valve keeper fitting 58 is first slid below the valve stem 22 beyond the plurality of radial grooves 76 disposed on the upper portion of the valve stem 22 which are adapted to receive a pair of conventional or stock valve keepers 78. Next the pair of valve keepers 78 are installed onto the upper portion of the valve stem 22. In particular, the valve keepers 78 are clam-shelled around the valve stem 22 such that they form a frustro-conical shape which is adapted to be received into a frustro-conical shaped seat 80 formed within the valve keeper fitting 58. The valve keeper fitting 58 is a generally cylindrical shaped fitting having bore 83 disposed through the center axis of the fitting such that the valve stem 22 may be received through the bore 83. As discussed above, the upper portion of the fitting 58 includes a frustro-conical shaped seat 80 formed therein which is adapted to receive the valve keepers 78 in a compression fit. Externally formed thereon the upper portion of the fitting 58 are conventional male threads 72 or the like which are adapted to be received by valve connecting fitting 62. Additionally, the lower portion of the valve keeper fitting 58 includes a bolt head shaped or square shaped portion which is adapted to be tightened by a wrench. It is additionally noted that an optional coil spring 70 which acts as a dampener may be disposed between the distal tip 19 of the valve stem 22 and the backing surface 68 of the valve tip seat 66 formed within the lower fitting 63 of the valve connecting fitting 62.

Figure 4:
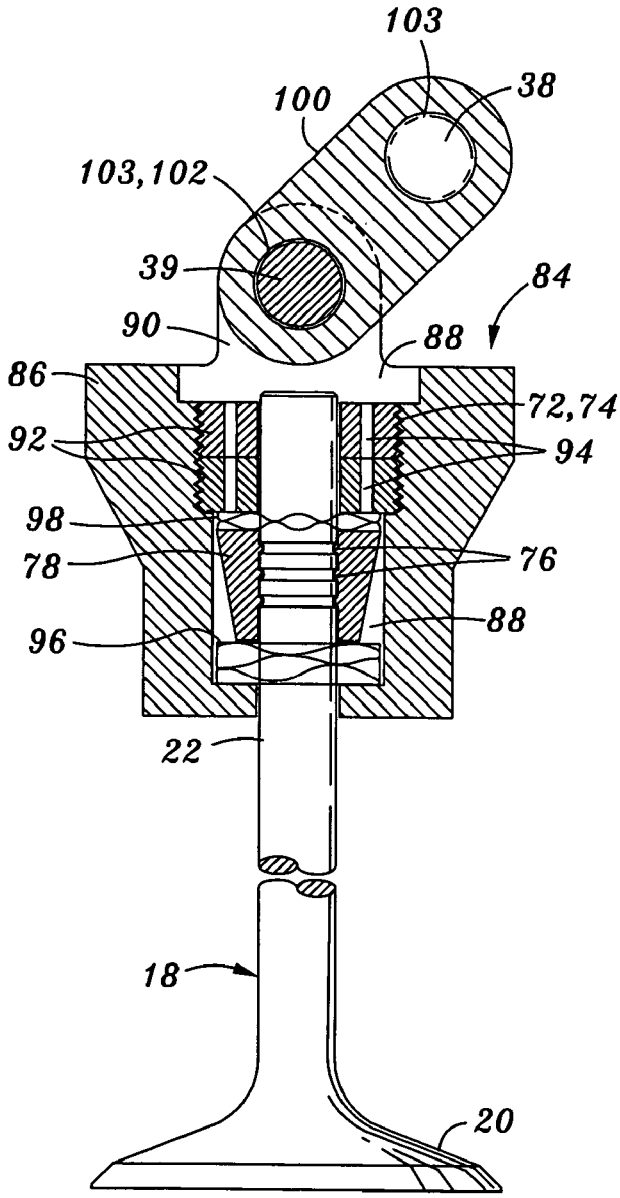
FIG. 4 shows detailed cross-sectional view of an alternative embodiment of another valve connector assembly, which includes linking member, a pair of threaded locking retainers, a pair of valve keepers, and a pair of wave washers, according to an aspect of the present invention.

FIG. 4 shows a detailed cross-sectional view of an alternative embodiment of an exemplary valve connector assembly 84, according to an aspect of the present invention. In this embodiment, a main valve connector body 86 is provided with an internal cavity 88 which is adapted to receive the upper portion of the valve stem 22 and further house numerous parts including a pair of threaded locking retainers 92, a pair of wave washers 96, 98 and a pair of conventional valve keepers 78 (similar to those of the first embodiment). In particular, the internal cavity 88 has a lower cylindrical portion adapted to receive at least one first wave washer 96, the valve keepers 78 and at least one second wave washer 98. To retain the aforementioned assembly inside the internal cavity 88, including the distal end of the valve stem 12, an upper portion of the internal cavity 88 is provided with convention female threads 74 or the like for receiving a pair of threaded locking retainers 92. The locking retainers 92 may include passages 94 which are adapted to receive a tool for installation purposes. Furthermore, the passages are also adapted to function as oiling system passages. By installing the pair of threaded locking retainers 92, not only are the pair of wave washers 96, 98, pair of conventional valve keepers 78, and the upper valve stem 22 retained within the internal cavity 88, but also by selection of wave washers 96, 98 having various combinations of spring resistances, preloads may be applied and/or adjustments to of the position of the valve 12 with respect to the main body 86 may be made which is somewhat similar to adjusting the lash. Thus, this feature provides adjustability with regard to how the head 20 of the valve 18 seats in the valve seat 21. Moreover, the aforementioned wave washers 96, 98 help prevent damage to the head 20 of the valve 18 if the valve head 20 is hitting the valve seat 21 when the valve 18 is in its closed position. Thus, one of the benefits of the alternative valve connector assembly 84 is that the valve position and/or lash may be adjusted to prevent the valve head 20 from being pulled excessively against the valve seat 21, while at the same time providing a shock absorbent feature to ensure the valve head 20 is being sufficiently pulled upwards to the valve seat 21 for proper closing and sealing of the combustion chamber. It is further noted that formed upon the upper end of the main valve connector body 86 are a pair of yoke arms 90 (only one of two shown in FIG. 4) which are adapted to rotatably receive a second connecting pin 39 through a receiving hole 102 disposed through each yoke arm 90. Furthermore, as shown in FIG. 4, a linking member 100 is provided which includes a pair of pin receiving holes 103 for rotatably receiving the second connecting pin 39 and the valve connecting pin 38 from the connecting rocker 32.

Figure 5:
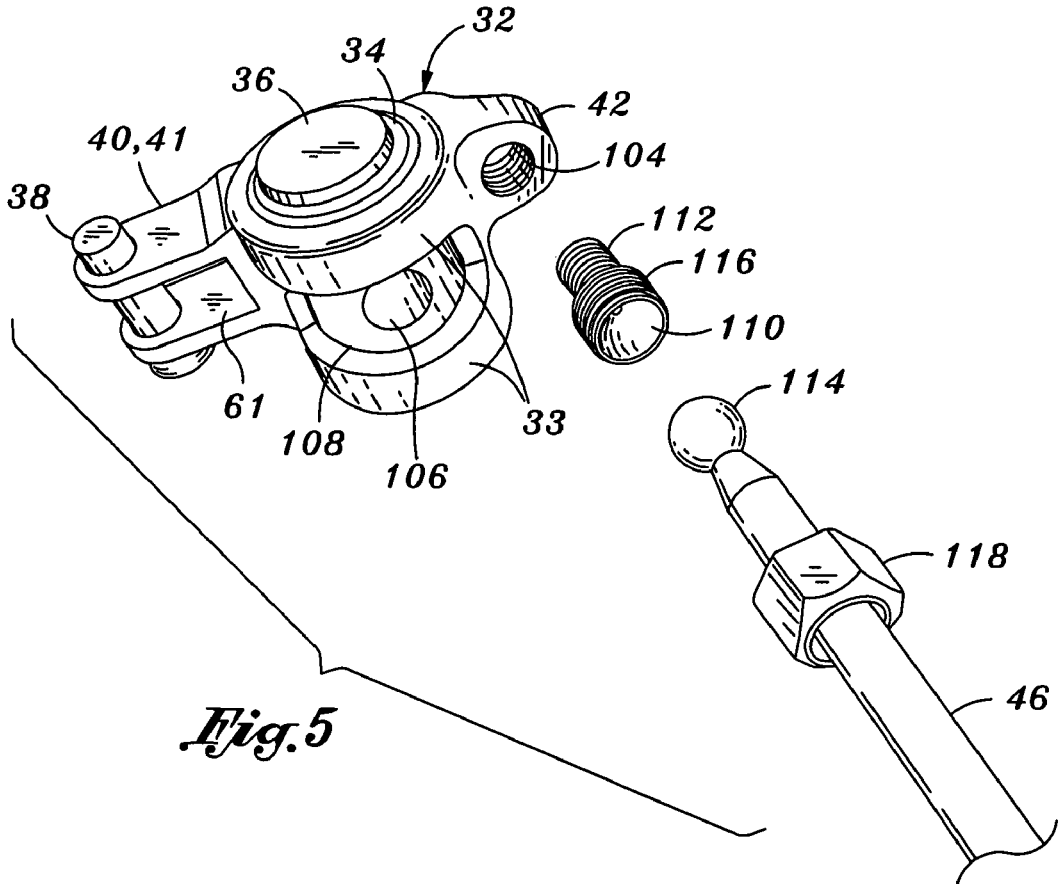
FIG. 5 shows a perspective view from underneath of the rocker, including an exploded view of the ball joint assembly and pushrod, according to an aspect of the present invention.
Figure 6:
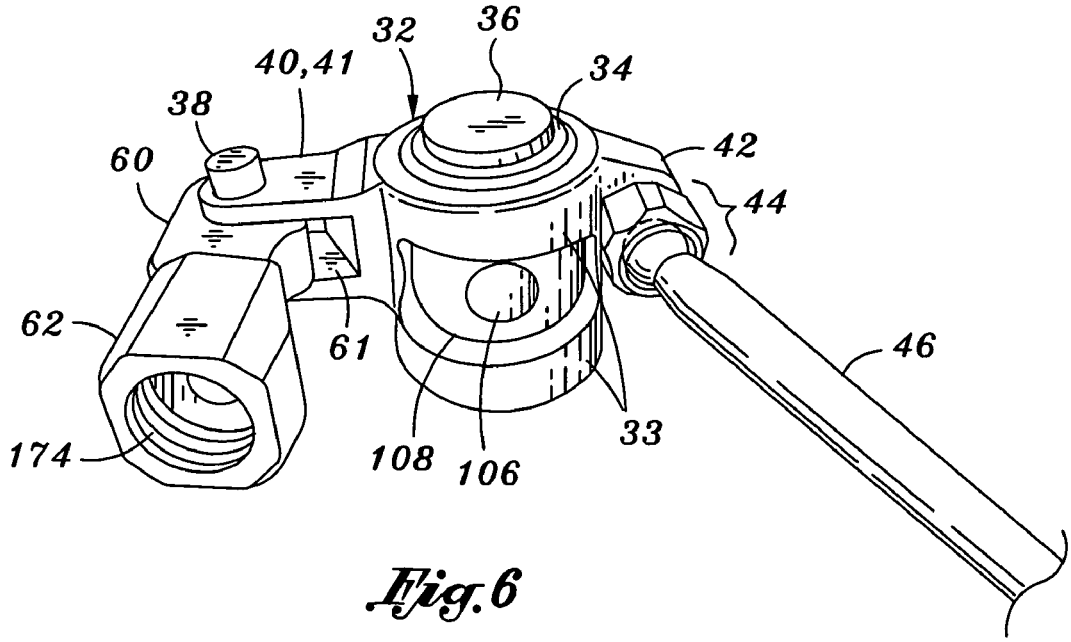
FIG. 6 shows another perspective view from underneath of the rocker, including the valve connecting fitting, ball joint assembly, and pushrod in an assembly, according to an aspect of the present invention.

FIG. 5 shows a perspective view from underneath an exemplary connecting rocker 32, including an exploded view of the ball joint assembly 44 and pushrod 46, according to an aspect of the present invention; while FIG. 6 shows an assembly of the same parts, according to an aspect of the present invention. The connecting rocker 32 contains some design features derived from a conventional rocker. For instance, the main body 33 of the rocker 32 is cylindrical in shape and includes a bore disposed through the rocker body 33 which is adapted to be received a pair of rocker bearings 34, which in turn are adapted to rotatably hold the rocker shaft 36. Disposed perpendicularly through the rocker shaft 36 is stud receiving bore 106 which is adapted to receive rocker mounting stud 30 (see FIGS. 1 and 2). The rocker shaft 36 includes a countersunk portion for receiving a mounting nut 150 which is threaded onto the mounting stud 30. Further, the rocker body 33 includes a semi-circular swivel slot 108 on the bottom side thereof, so that the mounting stud 30 can be connected through to the rocker shaft 36. Additionally, an opening/void is provided on the top of the rocker body 33 (not shown) to provide access for the mounting nut 150 which is used to secure the rocker shaft 36 down onto the mounting stud 30.

Still referring to FIGS. 5 and 6, the connecting rocker 32 further includes a valve movement end 40, which includes a pair of opposing arms 41 having a receiving slot 61 formed there between. Additionally, the valve connecting pin 38 transversely spans across both arms 41. As shown in FIG. 6, the rocker connecting end 60 of the valve connecting fitting 62 is adapted to rotatably and slidably receive the valve connecting pin 38. On the other side of the connecting rocker 32 is the pushrod connecting end 42 which has a threaded hole 104 (see FIG. 5) for attaching the ball joint assembly 44. The ball joint assembly 44 includes a ball socket fitting 110 which has a threaded external circumferential surface 116 and a threaded stem 112. The upper distal end of the pushrod 46 has a ball end 114 attached thereto which is adapted to be received by the ball socket fitting 110. A retaining cap 118 is then used to attach the pushrod 46 to the threaded external circumferential surface 116.

Figure 7:
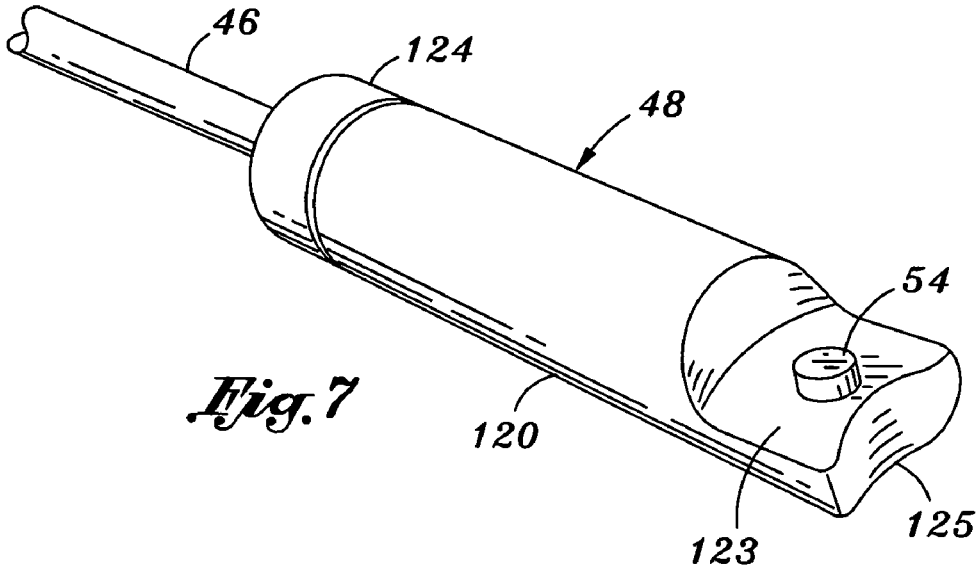
FIG. 7 shows a perspective view of the hydraulic lifter follower assembly attached to the lower end of a pushrod, according to an aspect of the present invention.
Figure 8:
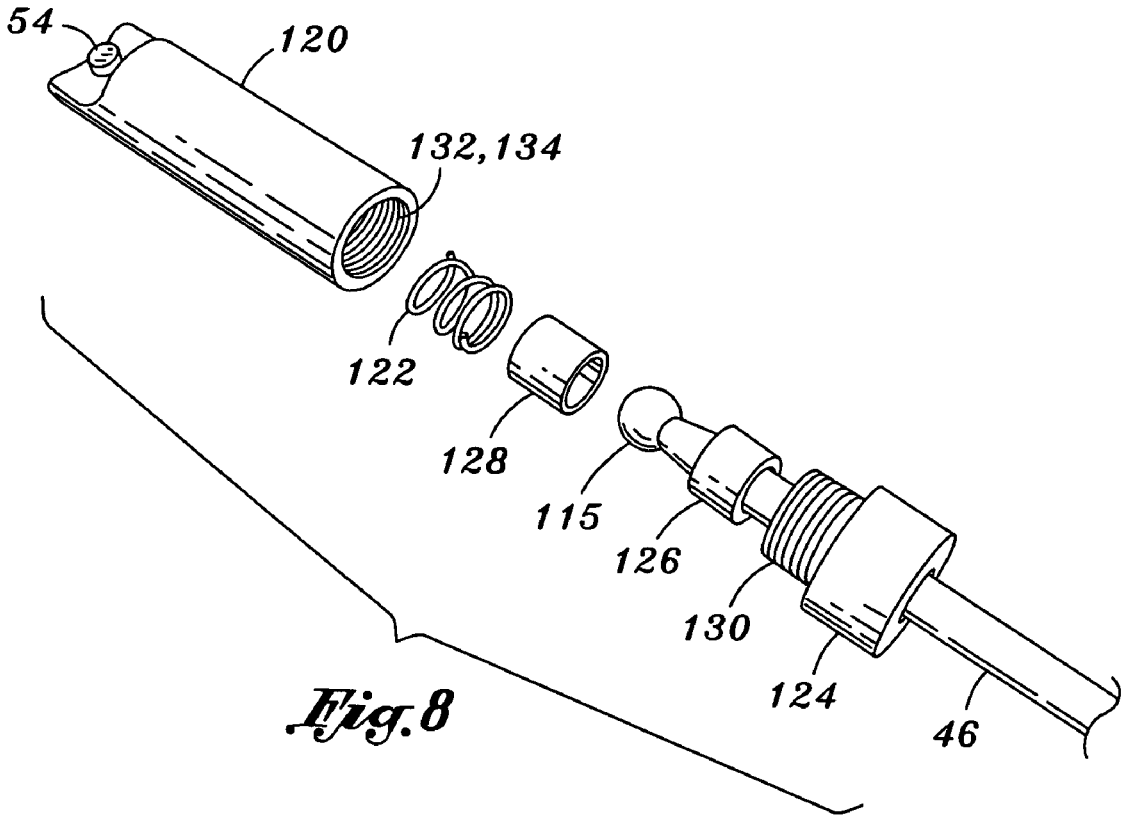
FIG. 8 shows an exploded view of the hydraulic lifter follower assembly attached to the lower end of a pushrod, according to an aspect of the present invention.

FIG. 7 shows a perspective view of an exemplary hydraulic lifter follower assembly 48 attached to the lower end of an exemplary pushrod 46, according to an aspect of the present invention; while FIG. 8 shows an exploded view of the hydraulic lifter follower assembly 48 attached to the lower end of a pushrod 46, according to an aspect of the present invention. The exemplary lifter assembly 48 may include a main lifter body 120, threaded lifter cap 124, coil spring 122, lower ball seat 128, a second ball end 115 on the other distal end of the pushrod 46 and upper ball receiving sleeve 126. The main lifter body 120 is cylindrically shaped so that it will fit in stock lifter seats provided within conventional engine blocks. On the distal end of the main lifter body 120 is a notched portion 123 for receiving a cam lobe 52 (see FIGS. 1 and 2) and a concave end 125 which provides clearance for the main camshaft 50. Preferably, a following groove pin 54 to be received in the follower groove 53 of the cam lobe 52 is installed into the notched portion 123. However, it is contemplated that any equivalent machine element which accomplishes the same tracking function may also be incorporated into the notched portion of the main lifter body 120. The main lifter body 120 further includes an internal cavity 134 disposed therein which is adapted to receive several parts, including the threaded lifter cap 124, coil spring 122, lower ball seat 128, the second ball end 115 on the other distal end of the pushrod 46 and upper ball receiving sleeve 126. As most conventional pushrods have incorporated therein, the exemplary pushrods 46 are also hollow for oiling system purposes. Therefore, oil is allowed to flow inside the hydraulic lifter follower assembly 48. In operation, oil is filled within the internal cavity 134 such that the lifter 48 acts as a dampener that maintains a constant, yet adjustable tension, on the connecting rocker 32. Furthermore, since hydraulic lifters 48 are used in the present invention desmodromic cam and valve system 2, the valves 18 in the present invention do not need to be adjusted.

Figure 9:
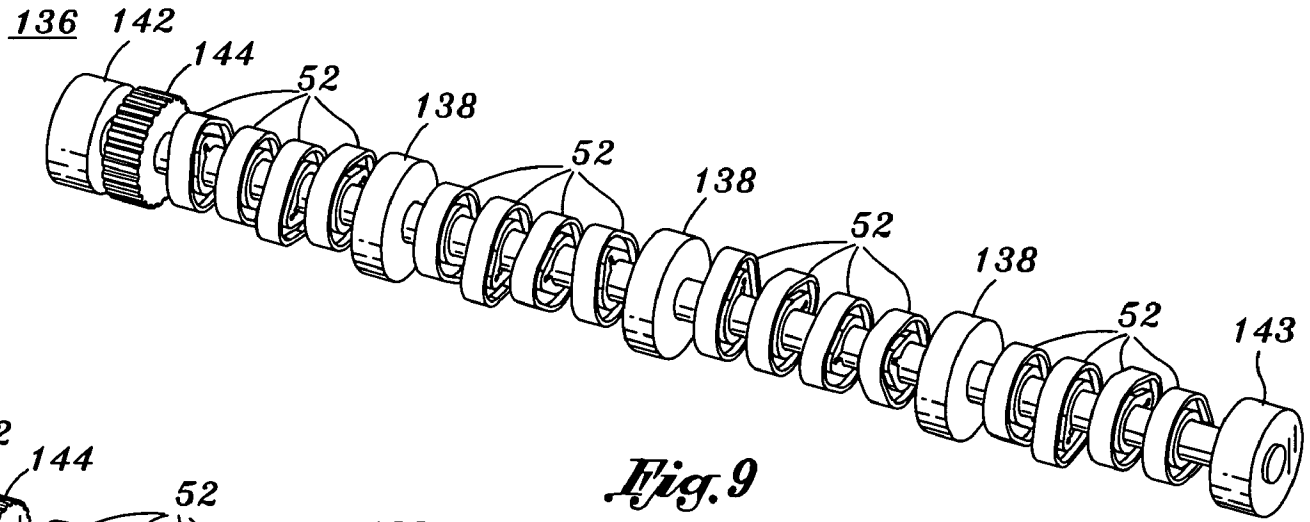
FIG. 9 shows a perspective view of the camshaft assembly which includes a separate main camshaft, numerous cam lobes, a camshaft gear, several camshaft bushings, camshaft gear hub and end hub, according to an aspect of the present invention.
Figure 10:
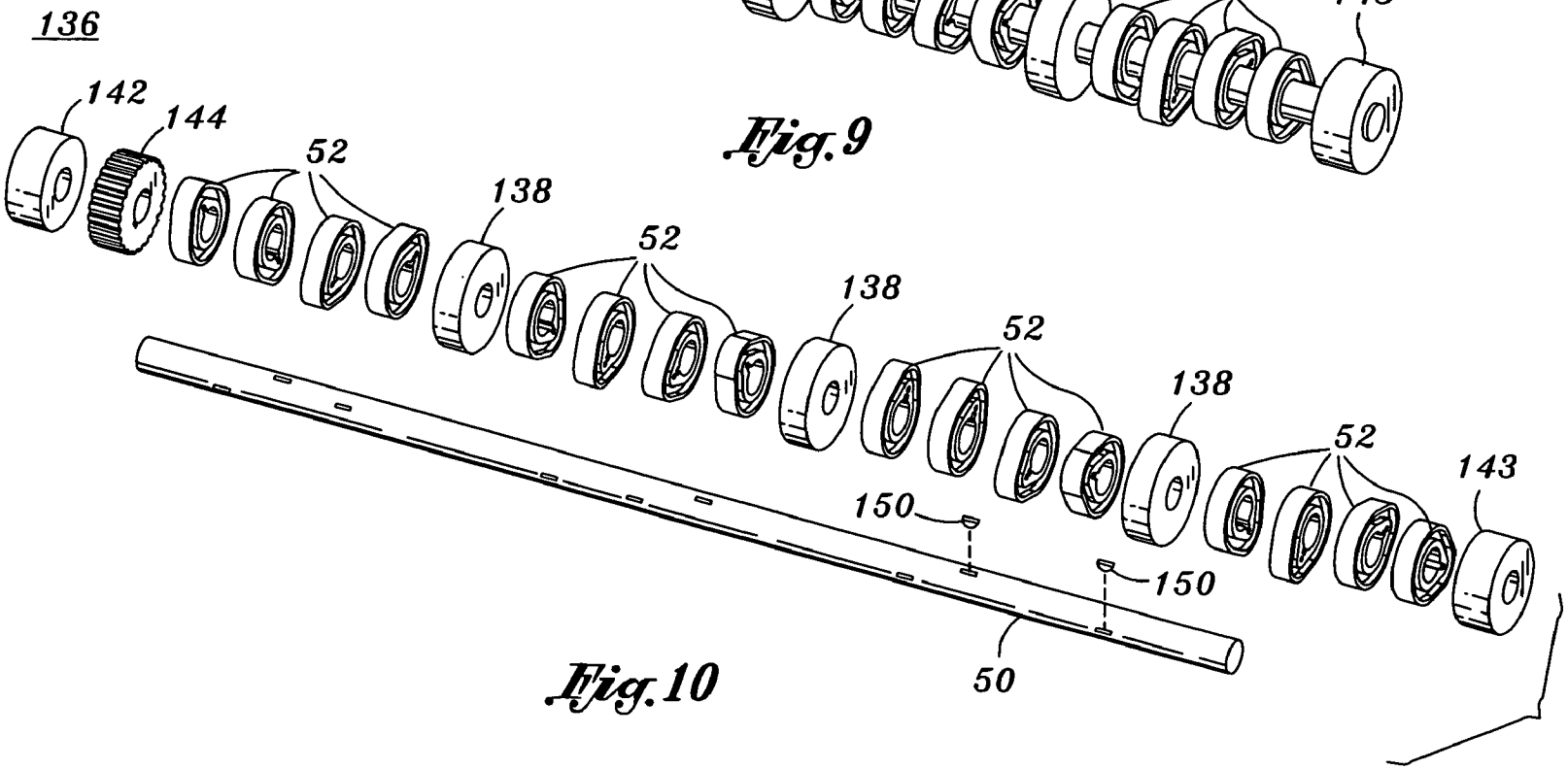
FIG. 10 shows an exploded of the camshaft assembly from FIG. 9, according to an aspect of the present invention.

FIG. 9 shows a perspective view of an exemplary camshaft assembly 136 which includes a separate main camshaft 50, numerous cam lobes 52, a camshaft gear 144, several camshaft bushings 138, a camshaft timing sprocket/gear hub 142 and end hub 143, according to an aspect of the present invention; while FIG. 10 shows an exploded of the camshaft assembly 136 from FIG. 9, according to an aspect of the present invention. It is noted that the exemplary camshaft assembly 136 shown in FIGS. 9 and 10 is adapted for a conventional V-8; however, a similar cam assembly may also be adapted for other pushrod configured engines, such as V-6's, V-10's, or even inline engines which use pushrods. As is best illustrated in FIG. 10, the main camshaft 50 has a plurality key receiving slots 146 that are formed in the outer surface of the main camshaft 50 in a longitudinal orientation with respect to the axis of the camshaft 50. Furthermore, each of the cam lobes 52 also includes a key receiving slot 55. Both key receiving slots 55 and 146 are adapted to receive a woodruff key 148 or the like, thereby providing a means for fastening the plurality of cam lobes 52 to the main camshaft 50. The key receiving slots 146 are formed in varying radial positions about the circumference of the camshaft 50 and further spaced at desired intervals along the longitudinal length of the camshaft 50. Further, each cam lobe 52 includes at least one follower groove 53 which is adapted to receive the follower groove pin 54 or an equivalent means disposed on the distal end of the hydraulic lifter follower assembly 48. Another one of the aspects of the present invention is that the cam lobe assemblies. 52 may have varying profiles (or "grinds"), thereby, allowing adjustment of the duration and lift (i.e., how rapidly or quickly the valve 18 is opened and closed). That is to say, since the present invention is designed such that the cam lobes 52 may be removed and replaced, this allows one to install cam lobes 52 with varying following groove 53 shapes for tuning purposes. Therefore, it is envisioned that the camshaft assembly 136 may be provided with multiple cam lobe kits which include sets a cam lobes 52 which have varying performance characteristics.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and such uses are within the scope of the appended claims.

What is claimed is:

1. A desmodromic valve and cam system adapted to be installed into an internal combustion pushrod engine comprising an engine block and at least one head which utilizes at least one intake and one exhaust valve per cylinder, the system comprising:

a main camshaft assembly adapted to be received within a plurality of journals disposed internally within the engine block, the camshaft assembly including a cam lobe assigned to each valve, each cam lobe adapted to be removably installed onto a main camshaft, each cam lobe defined by a pair of opposing sides, perimeter edge, mounting hole disposed through the opposing sides in a normal orientation, and follower groove formed in at least one side of the cam lobe which is representative of a desired lift and duration performance characteristic;

a valve connector assembly installed onto a distal tip of each respective valve;

a rocker defined by a valve movement end and a pushrod connecting end, the valve movement end adapted to be mechanically linked to a respective valve connector assembly such that the rocker can either push down or pull up a respective valve and the pushrod connecting end adapted to be mechanically linked to an upper distal end of a pushrod such that the rocker can either push down or pull up a respective pushrod;

a hydraulic lifter follower assembly assigned to each valve which is adapted to be received within a lifter seat disposed within the engine block, each lifter assembly having a connecting means disposed on a distal end thereof which is adapted to engage and track a respective follower groove on a respective cam lobe; and a pushrod assigned to each valve, each pushrod having an upper and lower distal end, the upper distal end mechanically linked to the pushrod connecting end of a respective rocker and the lower distal end mechanically linked to a respective hydraulic follower lifter;

wherein when the main camshaft assembly rotates, the cam lobes impart reciprocal motion to the hydraulic lifters, which impart reciprocal motion to the pushrods, which impart a rocking motion to the valve movement end of the rocker, which results in each valve being reciprocally moved upwards to a closed position or downwards to an open position as a function of each cam lobe's lift and duration without the need to use valve springs to return the valves to a closed position.

2. The desmodromic valve and cam system according to claim 1, wherein the hydraulic lifter follower assemblies automatically adjust valve lash for each respective valve.

3. The desmodromic valve and adjustable cam system according to claim 1, the valve connector assembly comprising, a valve connecting fitting comprising, a rocker connecting end portion with a receiving slot formed therein which is adapted to slidably and rotatably receive a connecting pin from the valve movement end of the rocker; and a lower fitting portion adapted to receive a valve keeper fitting, the lower fitting portion including a hollow valve tip seat adapted to receive the distal end of a respective valve;

a valve keeper fitting adapted be fastened into the lower fitting portion; and a pair of valve keepers.

4. The desmodromic valve and cam system according to claim 3, the valve keeper fitting having a bore disposed there through for receiving a valve stem from a respective valve, the keeper fitting further comprising, an upper portion having a frustro-conical shaped seat formed therein; and a lower portion having a flange adapted to be received by a tool;

wherein each respective valve has at least one radial groove formed on the valve stem for receiving the pair of valve keepers;

wherein the valve keeper fitting is adapted to be installed into the lower fitting portion of the valve connecting fitting such that the pair of valve keepers are received into the frusto-conical shaped seat and maintained by a compression fit.

5. The desmodromic valve and cam system according to claim 4, further including a coil spring positioned between the distal tip of the valve stem and the valve connector for dampening shock imparted to the valve.

6. The desmodromic valve and cam system according to claim 1, the valve connector assembly comprising, a main valve connector body adapted to be connected to the distal tip of a respective valve, the body defined by a center axis, a lower end having a radial flange with a hole disposed there through for receiving the upper end of the valve, an upper end having a pair of opposing yokes arms projecting upwards, each arm having a pin receiving hole, and an internal cavity disposed through the body about the center axis from the upper end and terminating within the body to form a backside of the radial flange about the center axis;

a first connecting pin installed into the pin receiving holes of the yoke arm; and a linking member having a pair pin receiving holes, the linking member being rotatably connected to a second connecting pin via one of the pin receiving holes and further rotatably connected to the valve connector pin disposed on the valve movement end of the rocker via the other pin receiving hole.

7. The desmodromic valve and cam system according to claim 6, the valve connector further comprising, at least one first wave washer adapted to be received by the valve stem, the first wave washer being positioned adjacent the backside of the radial flange;

a pair of frustro-conically shaped valve keepers adapted to be received by at least one radial groove formed on the valve stem for receiving the pair of valve keepers, the valve keepers being positioned over the at least one first wave washer;

at least one second wave washer adapted to be received by the valve stem, the second wave washer being positioned over the valve keepers; and at least one locking retainer adapted to be received by the valve stem, the at least one locking retainer positioned over the at least one second wave washer.

8. The desmodromic valve and cam system according to claim 1, each rocker comprising, a main body having a bored disposed therethrough for receiving a pair of rocker bearings and a rocker shaft which is adapted to be mounted to a mounting stud protruding from the head;

a valve movement end comprising a pair of opposing arms having a receiving slot formed therebetween and a valve connecting pin transversely spanning across both arms, the pin being adapted to be rotatably received by a respective valve connector assembly; and a pushrod connecting end which has a threaded hole which is adapted to receive a ball joint assembly.

9. The desmodromic valve and cam system according to claim 1, the hydraulic lifter follower assembly comprising, a generally cylindrically-shaped lifter body having a cylindrical cavity disposed therein with an opening to the cavity formed on one end thereof, the lifter body having a notched portion disposed on the other end thereof, the notched portion including a groove pin to be received by a respective follower groove from a cam lobe;

a coil spring concentrically adapted to be retained internally within cylindrical cavity;

a cylindrical shaped lower ball seat adapted to be retained internally within the cylindrical cavity above the coil spring;

an upper ball receiving seat sleeve adapted to be received by a respective pushrod; and a lifter cap adapted to be received by the respective pushrod, the lifter cap further adapted to be attached to the opening to the cavity formed on the end of the lifter body;

wherein oil is fed through each respective pushrod into the cavity formed in the lifter body;

wherein the lifter acts as a dampener that maintains a constant, yet adjustable tension, to the rocker.

10. The desmodromic valve and adjustable cam system according to claim 1, the camshaft assembly further comprising, a drive hub removably attached to one end of the camshaft assembly adapted to receive a timing drive sprocket;

a gear hub removably attached to the camshaft assembly proximate the drive hub;

a plurality of camshaft bushings removably attached to the camshaft assembly; and an end hub removably attached to the other end of the camshaft assembly.

11. The desmodromic valve and cam system according to claim 1, the mounting hole of each cam lobe having a cam lobe key receiving slot formed along a length of the mounting hole; and the main camshaft having a camshaft key receiving slot disposed in an exterior surface of the shaft for each respective cam lobe;

wherein a key is installed into the cam lobe key receiving slot for each cam lobe and a respective camshaft key receiving slot assigned to each respective cam lobe for rigidly securing the cams lobes to the main camshaft.

12. The desmodromic valve and adjustable cam system according to claim 1, further comprising a plurality of cam lobe assembly kits adapted to be installed and removed onto the main camshaft, wherein each kit provides a differing cam profile offering a unique set of lift and duration tuning characteristics for each respective kit.

13. A desmodromic valve and cam system retrofit kit for a pushrod engine comprising:

a main camshaft assembly having removable cam lobes, each cam lobe having mounting hole formed there through, and follower groove formed in at least one side of the cam lobe;

a valve connector assembly adapted to be installed onto a distal tip of each valve of the engine;

a rocker having a valve movement end and pushrod connecting end, the valve movement end adapted to be mechanically linked to a respective valve connector assembly such that the rocker can either push down or pull up a respective valve and the pushrod connecting end adapted to be mechanically linked to an upper distal end of a pushrod such that the rocker can either push down or pull up a respective pushrod;

a hydraulic lifter follower assembly assigned to each valve which is adapted to be received within a lifter seat disposed within the engine block, each lifter assembly having a connecting means disposed on a distal end thereof which is adapted to engage and track a respective follower groove on a respective cam lobe; and a pushrod assigned to each valve, each pushrod having an upper and lower distal end, the upper distal end adapted to be mechanically linked to the pushrod connecting end and the lower distal end adapted to be mechanically linked to a respective hydraulic follower lifter;

whereby the retrofit kit allows conventional valve springs to be removed from the engine's valvetrain, thereby increasing horsepower, fuel efficiency while reducing emissions.

14. The desmodromic valve and adjustable cam system retrofit kit according to claim 13, the valve connector assembly comprising, a valve connecting fitting comprising, a rocker connecting end portion with a receiving slot formed therein which is adapted to slidably and rotatably receive a connecting pin from the valve movement end of the rocker; and a lower fitting portion adapted to receive a valve keeper fitting, the lower fitting portion including a hollow valve tip seat adapted to receive the distal end of the a respective valve;

a valve keeper fitting adapted be fastened to the lower fitting portion; and a pair of valve keepers.

15. The desmodromic valve and cam system retrofit kit according to claim 14, the valve keeper fitting having a bore disposed there through for receiving a valve stem from each respective valve, the keeper fitting further comprising, an upper portion having a frustro-conical shaped seat formed therein; and a lower portion having a flange adapted to be received by a tool;

wherein each respective valve has at least one radial groove formed on the valve stem for receiving the pair valve keepers;

wherein the valve keeper fitting is adapted to be installed into the lower fitting portion of the valve connecting fitting such that the pair of valve keepers are received into the frusto-conical shaped seat and maintained by a compression fit.

16. The desmodromic valve and cam system retrofit kit according to claim 15, further including a coil spring positioned between the distal tip of the valve stem and the valve connector for dampening shock imparted to the valve.

17. The desmodromic valve and cam system according to claim 13, the valve connector assembly comprising, a main valve connector body adapted to be connected to the distal tip of a respective valve, the body defined by a center axis, a lower end having a radial flange with a hole disposed there through for receiving the upper end of the valve, an upper end having a pair of opposing yokes arms projecting upwards, each arm having a pin receiving hole, and an internal cavity disposed through the body about the center axis from the upper end and terminating within the body to form a backside of the radial flange about the center axis;

a first connecting pin installed into the pin receiving holes of the yoke arm;

a linking member having a pair pin receiving holes, the linking member being rotatably connected to a second connecting pin via one of the pin receiving holes and further rotatably connected to the valve connector pin disposed on the valve movement end of the rocker via the other pin receiving hole.

18. The desmodromic valve and cam system retrofit kit according to claim 17, the valve connector further comprising, at least one first wave washer adapted to be received by the valve stem, the first wave washer being positioned adjacent the backside of the radial flange;

a pair of frustro-conically shaped valve keepers adapted to be received by at least one radial groove formed on the valve stem for receiving the pair of valve keepers, the valve keepers being positioned over the at least one first wave washer;

at least one second wave washer adapted to be received by the valve stem, the second wave washer being positioned over the valve keepers; and at least one locking retainer adapted to be received by the valve stem, the at least one locking retainer positioned over the at least one second wave washer.

19. The desmodromic valve and cam system retrofit kit according to claim 13, each rocker comprising, a main body having a bored disposed there through for receiving a pair of rocker bearings and a rocker shaft which is adapted to be mounted to a mounting stud protruding from the head;

a valve movement end comprising a pair of opposing arms having a receiving slot formed therebetween and a valve connecting pin transversely spanning across both arms, the pin being adapted to be rotatably received by a respective valve connector assembly; and a pushrod connecting end which has a threaded hole which is adapted to receive a ball joint assembly.

20. The desmodromic valve and cam system retrofit kit according to claim 13, the hydraulic lifter follower assembly comprising, a generally cylindrically-shaped lifter body having a cylindrical cavity disposed therein with an opening to the cavity formed on one end thereof, the lifter body having a notched portion disposed on the other end thereof, the notched portion including groove pin to be received by a respective follower groove from a cam lobe;

a coil spring concentrically adapted to be retained internally within cylindrical cavity;

a cylindrical shaped lower ball seat adapted to be retained internally within the cylindrical cavity above the coil spring;

an upper ball receiving seat sleeve adapted to be received by a respective pushrod; and a lifter cap adapted to be received by the respective pushrod, the lifter cap further adapted to be attached to the opening to the cavity formed on the end of the lifter body;

wherein oil is fed through each respective pushrod into the cavity formed in the lifter body;

wherein the lifter acts as a dampener that maintains a constant, yet adjustable tension, to the rocker;

wherein the lifter automatically adjusts valve lash for each respective valve.

21. The desmodromic valve and adjustable cam system retrofit kit according to claim 13, the camshaft assembly further comprising, a drive hub removably attached to one end of the camshaft assembly adapted to receive a timing drive sprocket;

a timing gear hub removably attached to the camshaft assembly proximate the drive hub;

a plurality of camshaft bushings removably attached to the camshaft assembly;

and an end hub removably attached to the other end of the camshaft assembly.

* * * * *